US006823809B2

(12) United States Patent
Hey

(10) Patent No.: US 6,823,809 B2
(45) Date of Patent: Nov. 30, 2004

(54) FLOATING WATERCRAFT LIFT APPARATUS AND METHOD

(75) Inventor: Kenneth Hey, Seattle, WA (US)

(73) Assignee: Sunstream Corporation, Kent, WA (US)

( * ) Notice: Subject to any disclaimer, the term of this patent is extended or adjusted under 35 U.S.C. 154(b) by 0 days.

(21) Appl. No.: 10/101,006

(22) Filed: Mar. 18, 2002

(65) Prior Publication Data

US 2002/0132537 A1 Sep. 19, 2002

Related U.S. Application Data

(60) Provisional application No. 60/276,358, filed on Mar. 16, 2001.

(51) Int. Cl.[7] ..... B63C 7/00

(52) U.S. Cl. ..... 114/45; 114/48; 405/3

(58) Field of Search ..... 114/44–54, 68, 114/123, 263, 360; 405/1, 3–7

(56) References Cited

U.S. PATENT DOCUMENTS

| | | | | | |
|---|---|---|---|---|---|
| 17,892 | A | * | 7/1857 | Ponton | 114/49 |
| 87,291 | A | * | 2/1869 | Richardson | 114/46 |
| 123,402 | A | * | 2/1872 | Janicki | 114/48 |
| 3,114,535 | A | * | 12/1963 | Burch | 254/127 |
| 3,412,702 | A | * | 11/1968 | Mann | 114/46 |
| 3,415,212 | A | * | 12/1968 | Hennig | 114/45 |
| 3,541,987 | A | * | 11/1970 | Barkley | 114/61.46 |
| 3,610,192 | A | * | 10/1971 | Mauritzen | 114/45 |
| 3,638,437 | A | * | 2/1972 | Fukuda | 405/12 |
| 3,657,751 | A | * | 4/1972 | Shaw | 441/37 |
| 3,782,317 | A | * | 1/1974 | Kriedt | 114/52 |
| 3,860,982 | A | * | 1/1975 | Rumsey | 114/344 |
| 3,895,592 | A | * | 7/1975 | King | 114/45 |
| 3,981,259 | A | * | 9/1976 | Harper, Jr. | 114/61.15 |
| 4,072,119 | A | * | 2/1978 | Williams | 114/45 |
| 4,092,790 | A | * | 6/1978 | Sonerud | 37/340 |
| 4,357,890 | A | * | 11/1982 | Anderson | 114/123 |
| 4,732,102 | A | * | 3/1988 | Holman et al. | 114/45 |
| 4,750,444 | A | | 6/1988 | Lemvig | |
| 4,763,592 | A | * | 8/1988 | Russ | 114/45 |
| 4,841,896 | A | * | 6/1989 | Fury | 114/312 |
| 4,895,479 | A | | 1/1990 | Michaelsen et al. | |
| 5,078,071 | A | * | 1/1992 | Miura | 114/263 |
| 5,131,342 | A | | 7/1992 | Sackett | |
| 5,184,914 | A | | 2/1993 | Basta | |
| 5,860,379 | A | | 1/1999 | Moody | |
| 6,032,601 | A | * | 3/2000 | Gates | 114/45 |
| 6,131,528 | A | * | 10/2000 | Meek et al. | 114/44 |
| 6,477,968 | B2 | * | 11/2002 | Powell | 114/46 |

FOREIGN PATENT DOCUMENTS

| | | | | | |
|---|---|---|---|---|---|
| DE | 3403592 | A1 | * | 8/1985 | B63B/35/36 |
| GB | 2005603 | A | * | 4/1979 | B63C/1/02 |
| JP | 62128896 | A | * | 6/1987 | B63C/1/02 |
| JP | 04317885 | A | * | 11/1992 | B63B/21/00 |

* cited by examiner

*Primary Examiner*—S. Joseph Morano
*Assistant Examiner*—Ajay Vasudeva
(74) *Attorney, Agent, or Firm*—George C. Rondeau, Jr.; Davis Wright Tremaine LLP

(57) ABSTRACT

The present invention is generally directed to a floating watercraft lift capable of raising and lowering a watercraft, and more particularly to a floating watercraft lift. In one embodiment, the watercraft lift includes a pair of longitudinally extending and approximately parallel floats with an apparatus for supporting and lifting the watercraft positioned between the floats. When the watercraft lift is positioned in a lowered position, the apparatus is submerged and each of the floats is in a first orientation and partially submerged. The apparatus may then be activated to move the watercraft lift to a raised position by moving the floats downwardly and inwardly towards the watercraft, so that the floats become further submerged in the water. The buoyancy of the submerging floats thus lifts the lift apparatus and the watercraft above the water surface.

46 Claims, 8 Drawing Sheets

FLOATING WATERCRAFT LIFT APPARATUS AND METHOD

CROSS-REFERENCE TO RELATED APPLICATION

This application claims priority to U.S. Provisional Application No. 60/276,358 filed Mar. 16, 2001.

TECHNICAL FIELD

This invention generally relates to lifts for watercraft, and more particularly, to floating watercraft lifts capable of raising and lowering a watercraft.

BACKGROUND OF THE INVENTION

A watercraft may encounter a variety of problems when a hull of the watercraft remains submerged in a lake, or other body of water, for a protracted period of time. For example, the watercraft may be subjected to significant physical damage when the hull is exposed to strong wave activity resulting from weather conditions or the wakes of passing watercraft. This damage generally occurs where the hull of the watercraft repeatedly contacts a stationary object such as a portion of a dock, floating debris, or even another watercraft that is docked nearby. Further, while the watercraft hull remains in the water, the exterior hull surfaces of the watercraft may acquire significant amounts of marine growth that may impair the performance of the watercraft, and superficially damage the hull surfaces if not frequently removed.

In response to these difficulties, watercraft lifting devices have been developed that generally include a user-actuated mechanical lifting mechanism that is positioned below the watercraft to lift it from the water and support it above the surface of the water when the watercraft is not in use. When it is desired to refloat the watercraft, the user is able to release the mechanical lifting mechanism to lower the watercraft into the water. The watercraft lift is therefore a particularly convenient solution to the foregoing difficulties, since the watercraft may be quickly removed from the water during periods of non-use, and refloated when desired, with minimal human effort.

One category of known watercraft lifts include a mechanical lifting mechanism that is attached to a support platform having columns, or other supports, that that extend downwardly from the platform to the bottom of a body of water. When the watercraft is supported by the lifting mechanism, the resulting load is transferred from the lifting mechanism to the bottom by the columns attached to the support platform. U.S. Pat. No. 4,895,479, for example, describes a watercraft lift that includes a lifting mechanism that is positioned below the water surface that is supported by a plurality of posts that are anchored to the bottom. Similarly, U.S. Pat. No. 5,184,914 also describes a lift having a submerged lifting mechanism supported above the bottom by a plurality of posts that are attached to the bottom.

One disadvantage present in this category of watercraft lifts is that they require that the watercraft lift be maintained in a fixed location, since the column supports are driven into the bottom of the body of water, or are otherwise attached to fixed anchor positions located on the bottom. Further, watercraft lifts that are attached to the bottom generally cannot accommodate significant water level variations that may exist in the body of water. Such variations in water level may be due, for example, to tidal activity if the water craft is maintained in a marine environment, or due to the storage or release of water from a nearby dam if the watercraft is maintained in a lake or river adjacent to the dam.

Another category of watercraft lifts includes one or more enclosed chambers that may be selectively inflated to lift the watercraft from the water surface. For example, U.S. Pat. No. 5,860,379 describes a watercraft lift having air chambers fabricated from a flexible, impermeable fabric that are positioned beneath the watercraft. A network of hoses and valves connects an air inflation device to the enclosed chambers. As inflation air is provided to the enclosed chambers, water is expelled from the chambers thus lifting the watercraft from the water surface. A similar watercraft lift is described in U.S. Pat. No. 4,750,444, which includes a platform for supporting the watercraft that has a downwardly extending lifting skirt having an open bottom that is connected to an air inflation device. By providing inflation air to the skirt, the platform that supports the watercraft may be raised above the water surface.

Although the operation of the foregoing watercraft devices is not generally limited by water level variations, other disadvantages nevertheless exist. For example, in order to provide sustained support for the watercraft, the inflation chambers must be capable of sealably containing the inflation air for prolonged periods of time. If the inflation chambers or the inflation system cannot sealably contain the inflation air, the watercraft will not be maintained in an elevated position above the water surface.

Still another category of watercraft lifts include one or more sealed floatation chambers that are moveable relative to the watercraft to raise and lower the watercraft. For example, U.S. Pat. No. 5,131,342 discloses a watercraft lift having a pair of spaced-apart floatation chambers with watercraft support beams positioned between the floatation chambers. The floatation chambers are translated in a vertical direction to partially raise and lower the watercraft. In order to fully submerge the support beams to receive the watercraft, however, the floatation chambers must be at least partially flooded with water. Correspondingly, when the watercraft lift is to raise the watercraft, water must be pumped from the floatation chambers to establish sufficient buoyancy to lift the watercraft from the water. Since the foregoing device is unable to effect a sufficient change in buoyancy by mechanically re-positioning the floats, it is therefore subject to the shortcomings described above since it relies on sealably containing inflation air within floatation chambers.

Accordingly, there is a need in the art for a watercraft lift to support a watercraft that is not limited by variations in water depth, and does not require support from the bottom of a body of water. Further, there is a need for a watercraft lift that does not require floatation chambers that must be inflated with air and/or flooded with water in order to develop sufficient changes in buoyancy to raise and lower the watercraft.

SUMMARY OF THE INVENTION

The present invention is generally directed to a floating watercraft lift capable of raising and lowering a watercraft, and more particularly to a floating watercraft lift that does require support from a bottom of a body of water and is capable of operation in water that may vary in depth. The watercraft lift may be positioned in a standard-sized boat slip, as well as in double-wide slips, where two such lifts may be used side by side, or only one lift may be used without impeding the berthing of a second watercraft in the slip. The watercraft lift may also be used separate from a slip or fixed dock, and may be anchored to a buoy, or other mooring devices, and may be conveniently and easily relocated to different locations when desired.

In one aspect of the invention, the watercraft lift includes a pair of longitudinally extending and approximately parallel floats with an apparatus for supporting and lifting a watercraft extending between the floats. When the watercraft lift is positioned in a lowered position, the apparatus is submerged and each of the floats is in a first orientation and partially submerged. When the watercraft enters the watercraft lift, it may be guided onto the lift by a pair of at least partially submerged and longitudinally extending bunks that extend lengthwise on either side of the watercraft. When the watercraft has moved a sufficient distance along the length of the lift, the watercraft contacts the bunks. The apparatus may then be activated to move the watercraft lift to a raised position. The apparatus moves the floats downwardly and inwardly towards the watercraft, so that the floats become further submerged in the water. The buoyancy of the submerging floats thus lifts the lift apparatus and the watercraft above the water surface.

DETAILED DESCRIPTION OF THE INVENTION

The present invention is directed to lifts for watercraft, and more particularly, to a floating watercraft lift capable of raising and lowering a watercraft. Many of the specific details of certain embodiments of the invention are set forth in the following description and in FIGS. 1 through 8 to provide a thorough understanding of such embodiments. One skilled in the art will understand, however, that the present invention may be practiced without several of the details described in the following description. In the following description of the embodiments, it is understood that a watercraft includes any vehicle that is at least partially waterborne, which may include boats or like vessels, and may also include amphibious vehicles including various amphibious automobiles or aircraft. Moreover, in the description that follows, it is understood that the figures related to the various embodiments are not to be interpreted as conveying any specific or relative dimension, and that specific or relative dimensions, if stated, are not to be considered limiting unless the claims expressly state otherwise.

Figure 1:
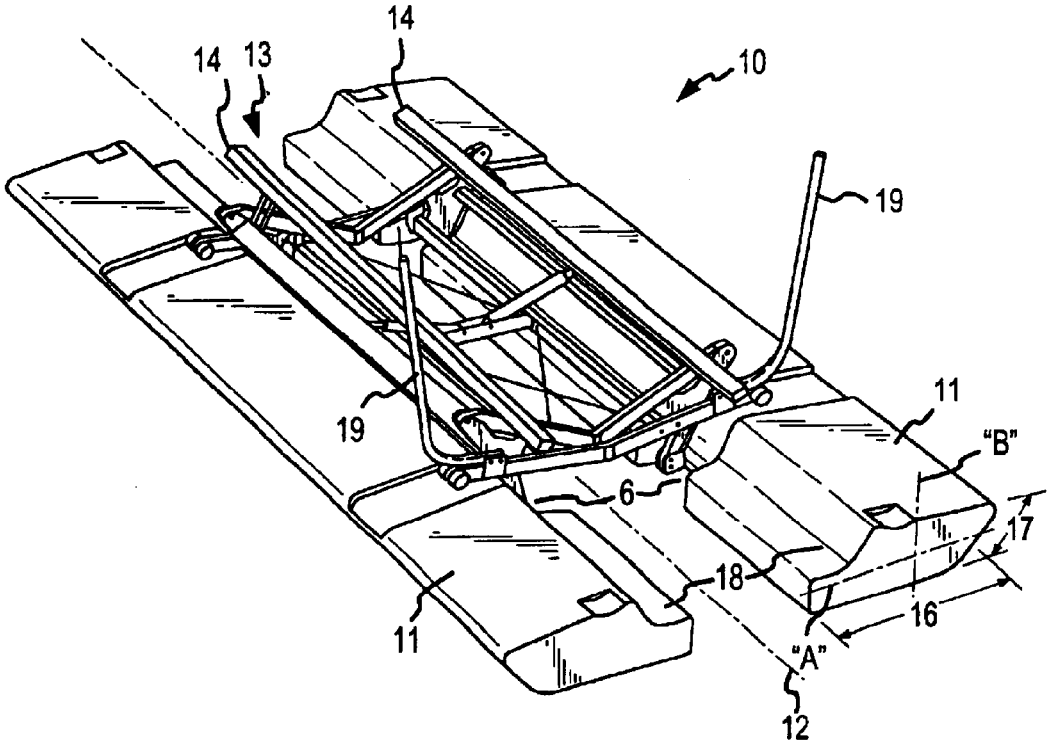
FIG. 1 is an isometric view of a watercraft lift according to an embodiment of the invention.

FIG. 1 is an isometric view of a watercraft lift 10 according to an embodiment of the invention. The watercraft lift 10 includes a pair of spaced apart, longitudinally-extending floats 11 that are approximately parallel to a longitudinal axis 12. The floats 11 may be comprised of a sealed and enclosed structure formed from a rigid and corrosion-resistant material, such as a rigid polymer, aluminum, or other like materials. The floats 11 may have a hollow interior volume to provide buoyancy when partially submerged in water. Alternatively, the floats 11 may include a material within the interior volume having a specific density less than that of water. For example, the internal volume of the floats may include a foamed polymeric material that at least partially occupies the internal volume of the floats 11.

Still referring to FIG. 1, the floats 11 are further approximately rectangular in cross section, having a first cross sectional dimension 16 that extends along a first cross sectional axis "A" and a second cross sectional dimension 17 that extends along a second cross sectional axis "B" that is substantially perpendicular to the first cross sectional axis "A", with the first dimension 16 being generally greater than a second dimension 17. The cross-section of the floats 11 may also include reduced cross-section portions 18 that significantly reduce the buoyancy afforded by the floats 11 by reducing the interior volume of the floats 11. Thus, when the floats 11 are moved from a position as shown in FIG. 1, where the floats 11 are oriented with the axis "A" in a horizontal position, to a vertical position where the axis "A" is oriented in a vertical position (not shown in FIG. 1), the reduced cross-section portion 18 will generally be submerged below a water surface, and provide less buoyancy to the lift 10, so that the lift 10 will generally extend further below the water surface due to the decreased buoyancy.

With reference still to FIG. 1, the watercraft lift 10 further includes a lifting structure 13 that is positioned between the floats 11 that is configured to receive and support a watercraft. The lifting structure 13 may include a pair of longitudinally-extending and spaced-apart bunks 14 that define support points for the watercraft. The bunks 14 may be angled upwardly and inwardly as they extend from a rear portion to a forward portion of the watercraft lift 10 to additionally provide a stop mechanism for the watercraft by contacting a hull portion of the watercraft once the watercraft is suitably positioned on the watercraft lift 10. The floats 11 may further include inwardly projecting cut-out portions 6 where the lifting structure 13 is mechanically coupled to the floats 11. A pair of generally upwardly-extending upright members 19 may also be attached to the lifting structure 13. The upright members 19 present visually prominent features to an operator of the watercraft that may assist the operator in locating the lift 10 prior to positioning the watercraft in the watercraft lift 10. Further, the upright members 19 may further assist the operator in guiding the watercraft into position between the floats 11.

Figure 2:
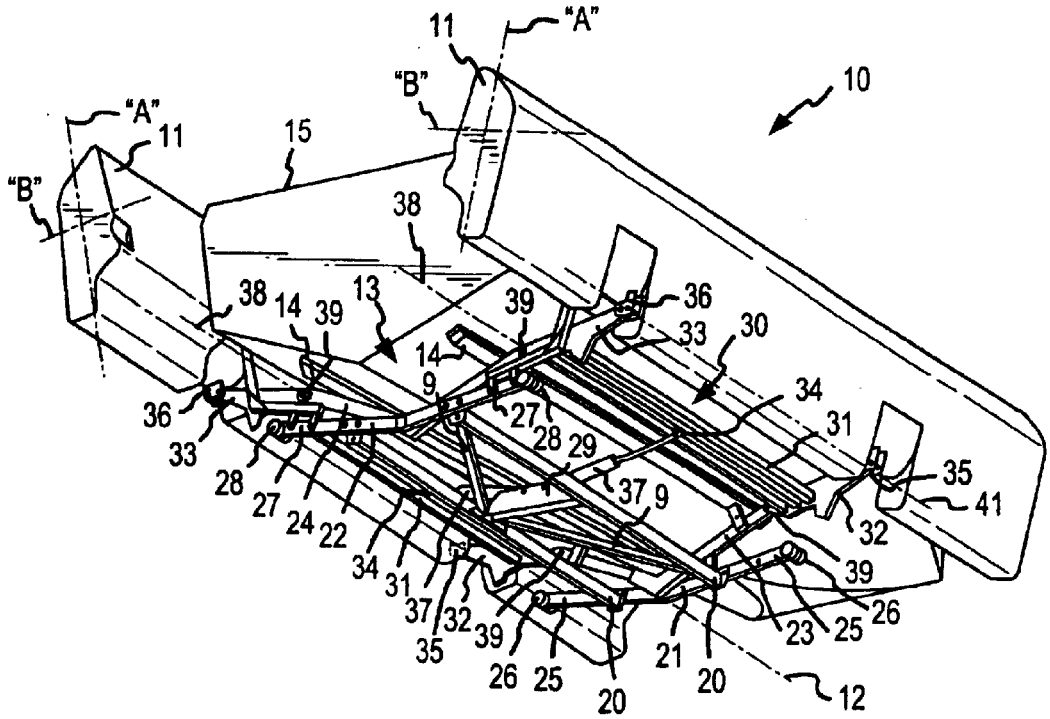
FIG. 2 is a partial isometric view of an under side of a watercraft lift according to an embodiment of the invention.

Turning now to FIG. 2, an isometric view of the underside of the watercraft lift 10 is shown. For clarity of illustration, the watercraft lift 10 as shown in FIG. 2 depicts the watercraft lift 10 configured in a position to receive a watercraft 15. Other positions for the watercraft lift 10 will be described in greater detail below. The lifting structure 13 includes a pair of longitudinally-extending side beams 20 that are generally parallel to the longitudinal axis 12. One end of each of the side beams 20 are coupled to a laterally-extending front cross-beam 21, with the opposing ends of the side beams 20 each coupled to a laterally-extending rear cross-beam 22 to form a substantially rectangular frame. One or more diagonal braces 9 may positioned within the rectangular frame to further reinforce the frame. A center beam 29 extends between the side beams 20, and is positioned approximately at a mid-length between the front cross beam 21 and the rear cross beam 22. The front cross beam 21 further includes a pair of opposing ends 25 that extend generally outwardly from the rectangular structure. The ends 25 each further include a rotatably-mounted rollers 26. Similarly, the rear cross beam 22 includes a pair of opposing ends 27 that also extend generally outwardly from the rectangular structure that each include rotatably-mounted rollers 28. The rollers 26 and 28 engage surface portions of the floats 11 during the operation of the watercraft lift 10, as will be described in greater detail below. Accordingly, the surface portions of the floats 11 that are contacted by the rollers 26 and 28 may have roller plates (not shown in FIG. 2) positioned on the surface portions of the floats 11 to locally reinforce the affected surface portions of the floats 11, and to generally guide the rollers 26 and 28 as they engage the floats 11. A front V-beam 23 is positioned on the side beams 20 proximate to the front cross beam 21, and a rear V-beam 24 is similarly positioned on the side beams 20 proximate to the rear cross beam 22. The front V-beam 23 and the rear V-beam 24 may support a pair of longitudinally-extending bunks 14, as earlier described. The front V-beam 23 and the rear V-beam 24 further include rotation points 39 positioned at opposing ends of the front V-beam 23 and the rear V-beam 24.

Referring still to FIG. 2, a pair of lift arm structures 30 are rotatably coupled to the front V-beam 23 and the rear V-beam 24 at the rotation points 39 so that each lift arm structure 30 is rotatable relative to the front V-beam 23 and the rear V-beam 24 about an axis 38 that projects through the rotation points 39. Each lift arm structure 30 includes a longitudinally extending beam 31 that is joined at one end to a forward lift arm cross beam 32 and at an opposing end to a rear lift arm cross beam 33. The lift arm structure 30 may be rotatably coupled to the floats 11 at a forward float clevis 35 and a rear float clevis 36 so that the floats 11 are rotatable relative to the lift arm structure 30 about an axis 41 that projects through the forward clevis 35 and the rear clevis 36. A pair of actuators, shown herein as a hydraulic cylinders 37 extend between the center beam 29 and a rotatable connection 34 proximate to the mid-length of the lift arm structure 30. Alternatively, the cylinders 37 may extend between the center beam 29 and the floats 11, with the cylinders 37 being rotatably coupled to the floats 11. Each cylinder 37 provides a linear actuation force that rotates the lift arm structure 30 about the rotational axis 38, so that the floats 11 may be positioned in an orientation where the cross-sectional axis "A" is oriented substantially vertically, as shown in FIG. 2, or to position the floats 11 in an orientation wherein the axis "A" is oriented substantially horizontally, as shown in FIG. 1. Although hydraulic cylinders 37 are shown, other means for imparting linear actuation may also be used. For example, a screw jack or a pneumatic cylinder may be used instead of the hydraulic cylinders 37. Still other devices may be used to controllably rotate the lift arm structure 30 about the axes 38. For example, a winch system that employs cables attached to the floats 11 to position the floats 11 relative to the lifting structure 13 may also be used.

Figure 3:
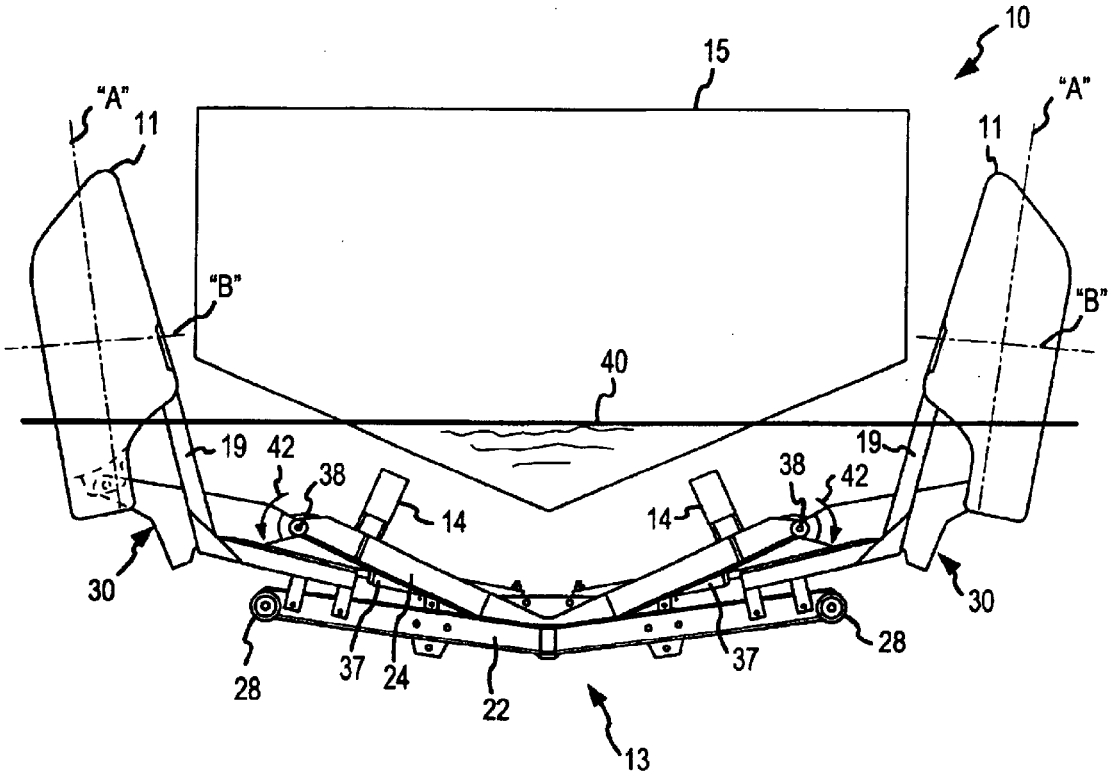
FIG. 3 is an end view of a watercraft lift according to an embodiment of the invention.
Figure 4:
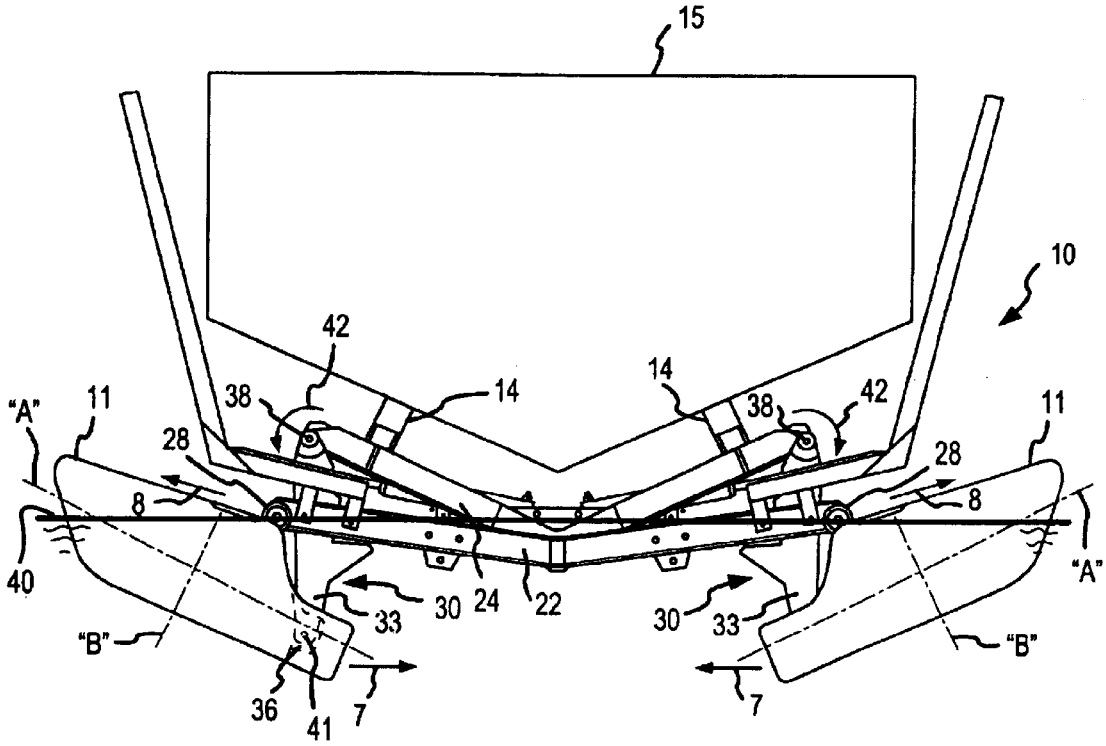
FIG. 4 is another end view of a watercraft lift according to an embodiment of the invention.
Figure 5:
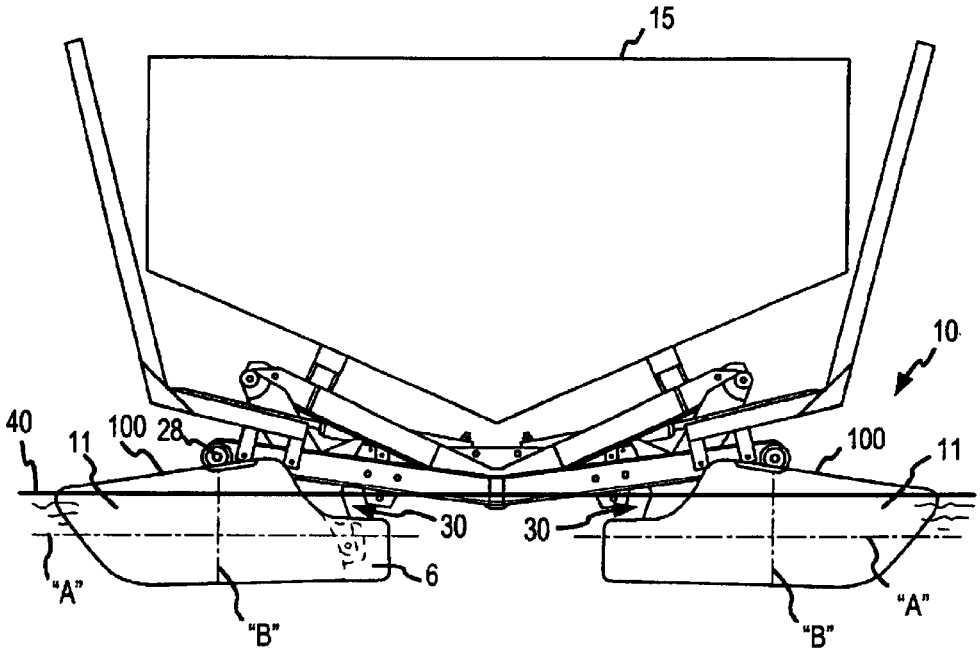
FIG. 5 is still another end view of a watercraft lift according to an embodiment of the invention.

With reference now to FIGS. 3 through 5, the operation of the watercraft lift 10 will be described in detail. FIG. 3 is an end view of the watercraft lift 10 that is configured in a fully lowered position to receive the watercraft 15. As discussed previously, when the watercraft lift 10 is positioned in the lowered position, the floats 11 are positioned with the axis "A" oriented in a substantially vertical orientation, which provides generally reduced buoyancy for the watercraft lift 10, due to the rectangular cross section of the floats 11, and further due to the reduced cross-sectional portions 18 of the floats 11. Consequently, the lifting structure 13 is positioned sufficiently below a waterline 40 so that the watercraft 15 may be positioned above the bunks 14. As the watercraft 15 proceeds into the watercraft lift 10, it may be guided by the floats 11, which are generally partially visible above the water surface 40. As the watercraft 15 continues to move forward, the hull of the watercraft 15 may contact a portion of the bunks 14, since the bunks 14 may be angled upwardly and inwardly as they extend from a rear portion of the watercraft lift 10 to a forward portion of the lift 10. The bunks 14 may thus assist a watercraft operator in positioning the watercraft 15 onto the lifting structure 13 by centering the hull of the watercraft 15 between the floats 11 and by at least partially arresting the forward motion of the watercraft 15 by providing resistance against the hull of the watercraft 15. With the watercraft 15 is positioned over the lifting structure 13 and between the floats 11 as shown, the lift assemblies 30 generally extend outwardly from the lifting structure 13, with the cylinders 37 in a filly extended position. The watercraft 15 may now be lifted by actuating a power supply system (not shown) that is coupled to the cylinders 37. The power supply system will be described in greater detail below.

Referring now to FIG. 4, an end view of the watercraft lift 10 is shown that depicts the watercraft lift 10 configured in an intermediate position between a fully lowered position (as shown in FIG. 3) and a fully raised position (as shown in FIG. 1). Actuation of the aforementioned power supply system (not shown) causes the cylinders 37 to linearly retract inwardly, thus causing the lift arm structures 30 to rotate about the axes 38 in a direction 42. As the lift arm structures 30 are rotated, the floats 11 are moved downwardly and inwardly towards the lifting structure 13 through a combination of a rotational movement of the floats 11 relative to the lifting arm structure 30 about the axis 41 that extends through the clevis 36 and the clevis 35 (as shown in FIG. 2), and a translation of the floats 11 relative to the lifting structure 13 so that the axis "A" progressively moves toward a horizontal orientation that is generally parallel to the waterline 40, while the axis "B" moves progressively towards a vertical orientation. As the floats 11 are moved, a greater portion of the internal volume of each of the floats 11 is submerged below the waterline 40, resulting in increased buoyancy for the watercraft lift 10. Consequently, the front V-beam 23 (as shown in FIG. 2) and the rear V-beam 24 are elevated to position the bunks 14 against the hull of the watercraft 15 and lift the watercraft 15 above the waterline 40.

Still referring to FIG. 4, the rollers 26 (as shown in FIG. 2) attached to the front cross-beam 21 (also as shown in FIG. 2) and the rollers 28 attached to the rear cross-beam 22 engage surface portions of the floats 11. As described earlier, roller plates 44 may be positioned on the floats 11 to reinforce the area contacted by the rollers 26 and 28, and to further guide the rollers 26 and 28 as they move across the floats 11 in a direction 8. The rollers 26 and 28 thus generally assist in rotating the floats 11 about the axis 41 while the cross beam 33 of the lift arm structure 30 draws the floats 11 inwardly in a direction 7. Although the present embodiment includes rollers 26 and 28 rotatably coupled to the front cross beam 21 and the rear cross beam 22, respectively, other means are available for engaging the surface portions of the floats 11. For example, the rollers 26 and 28 may be replaced by sliding members positioned on the front cross beam 21 and the rear cross beam 22 that slide across the surface portions of the floats 11. Still further, rollers may be rotatably mounted in the surface portions of the floats 11 that allow the sliding members to smoothly translate across the surface portions of the floats 11.

Turning now to FIG. 5, an end view of the watercraft lift 10 is shown with the watercraft lift 10 configured in the fully raised position. The lift arm structures 30 are fully rotated inwardly towards a center of the lifting structure 13, and may abut a portion of the floats 11. The rollers 26 attached to the front cross-beam 21 (as shown in FIG. 2) and the rollers 28 attached to the rear cross-beam 22 rest on the floats 11 to generally maintain the floats 11 in a horizontal position. Further, when the watercraft lift 10 is configured in the fully raised position, the axis "A" is oriented in a substantially horizontal direction that is parallel to the surface 40, while the axis "B" is oriented in a substantially vertical direction that is perpendicular to the surface 40. With the floats 11 positioned as shown, the floats 11 are more stable because a larger portion of the cross sectional area of the floats 11 is situated at the waterline when the axis "A" is oriented in the horizontal position.

The foregoing operating description of the watercraft lift 10 illustrates a significant advantage afforded by the watercraft lift 10. When the watercraft lift 10 is configured in the fully lowered position, as best shown in FIG. 3, the axis "A" of each of the floats 11 is oriented in a substantially vertical direction. Since the longest cross sectional dimension of the float 11 generally exists along the axis "A", the watercraft lift 10 has a relatively narrow overall width when positioned in the fully lowered position. Moreover, when the watercraft lift 10 is configured in the fully raised position, as best shown in FIG. 5, and the axis "A" of each of the floats 11 is oriented in a substantially horizontal direction, the floats 11 are positioned substantially beneath the watercraft 15, so that the watercraft lift 10 still maintains a relatively narrow overall width. Accordingly, the watercraft lift 10 may be advantageously accommodated and operated in narrow locations, such as narrow single watercraft slips, or other narrow mooring locations.

Figure 6A:
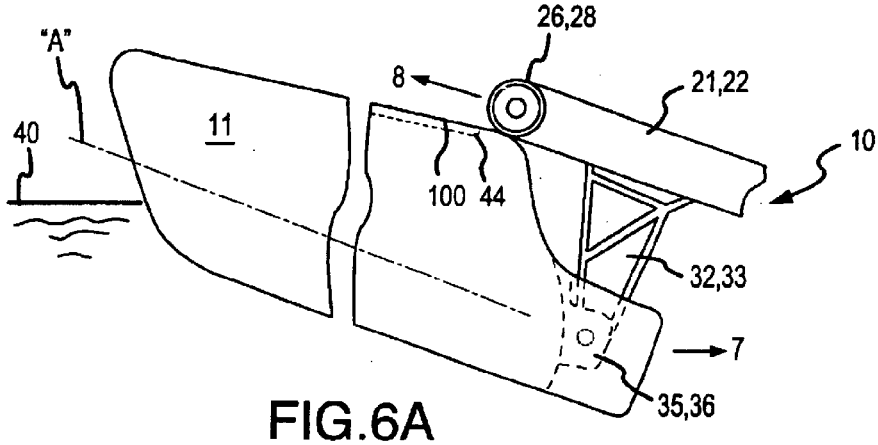
FIGS. 6A through 6C are partial cross sectional views of a watercraft lift according to an embodiment of the invention.
Figure 6B:
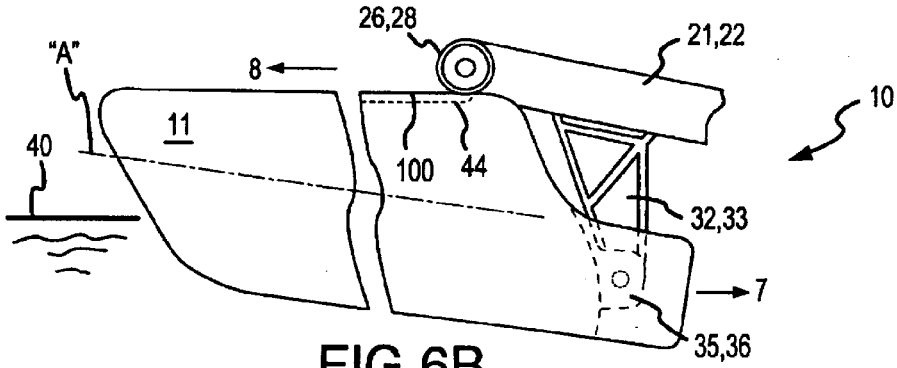
Figure 6C:
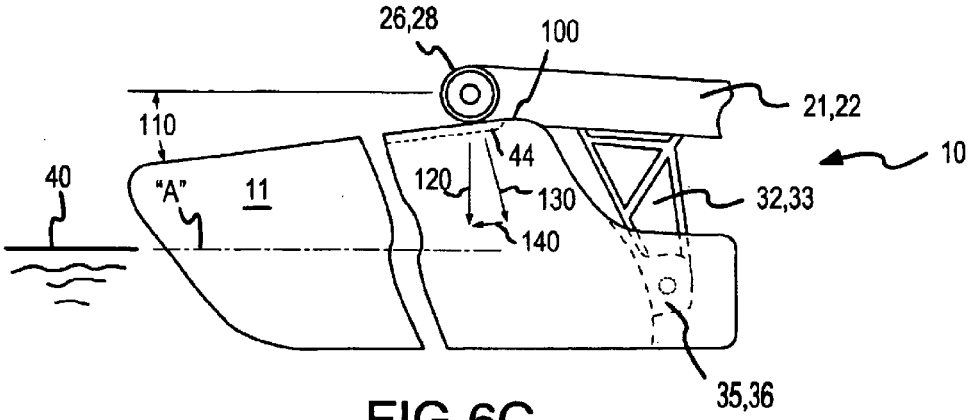

Still other advantages are apparent in the foregoing embodiment. For example, and still referring to FIG. 5, the downwardly-sloping surface 100 of the floats 11 advantageously permits the watercraft lift 10 to develop an over-center locking feature when the rollers 26 and 28 rest on the surface 100, as shown. With reference now to FIGS. 6A to 6C, this feature will be described in greater detail.

FIG. 6A is a partial cross sectional view of the floats 11 as the watercraft lift 10 is moved through an intermediate position between the fully lowered position (as shown in FIG. 3), and a fully raised position (as shown in FIG. 5). At the intermediate position shown, the axis "A" of the floats 11 are relatively steeply inclined relative to the horizontal, as determined by the surface 40. At the position shown in FIG. 6A, the rollers 26 coupled to the front cross beam 21, and the rollers 28 coupled to the rear cross beam 22 rotatably engage a portion of the surface 100 of the floats 11, and move onto the surface 100 in the direction 8, while the front clevis 35 and the rear clevis 36 move in the direction 7 due to the inwardly directed movement of the lift arm cross beams 32 and rear lift arm cross beams 33. As previously described, roller plates 44 may be positioned on the floats 11 to guide the rollers 26 and 28, and to reinforce the surface of the float 1 contacted by the rollers 26 and 28.

Referring now to FIG. 6B, a partial cross sectional view of the floats 11 as the watercraft lift 10 is moved further towards the fully raised position is shown (as best seen in FIG. 5). As shown, the rollers 26 and 28 continue to move onto and across the surface 100 in the direction 8 as the front clevis 35 and the rear clevis 36 continue to move inwardly in the direction 7. As the floats 11 continue to move, the axis "A" is moved to a less steeply inclined angle relative to the surface 40.

Turning now to FIG. 6C, a partial cross sectional view of the floats 11 is shown when the watercraft lift 10 is positioned in the fully raised position (as shown in FIG. 5). The axis "A" is now oriented substantially in a horizontal direction relative to the surface 40, and the surface 100 of the floats 11 extends downwardly at an angle 110 relative to the horizontal. A downwardly directed force vector 120, which arises from the weight of the watercraft and the lifting structure is transferred from the rollers 26 and 28 to the floats 11. As shown in FIG. 6C, the force vector 120 consists of a downwardly and inwardly directed first component 130, and an outwardly and downwardly directed second component 140 that cooperatively act to maintain the floats 11 in a stable and locked horizontal position when the lift 10 is in the fully raised position. Accordingly, the over-center feature advantageously maintains the watercraft lift 10 in the raised position without the participation of a latching mechanism, or other similar devices. Still further, since the load applied by the watercraft to the watercraft lift is advantageously transferred to the floats 11 through both the rollers 26 and 28 and through the float devises 35 and 36, greater stability is attained, which further advantageously permits the floats 11 to be utilized as a walkway for persons entering or leaving the watercraft.

Figure 7:
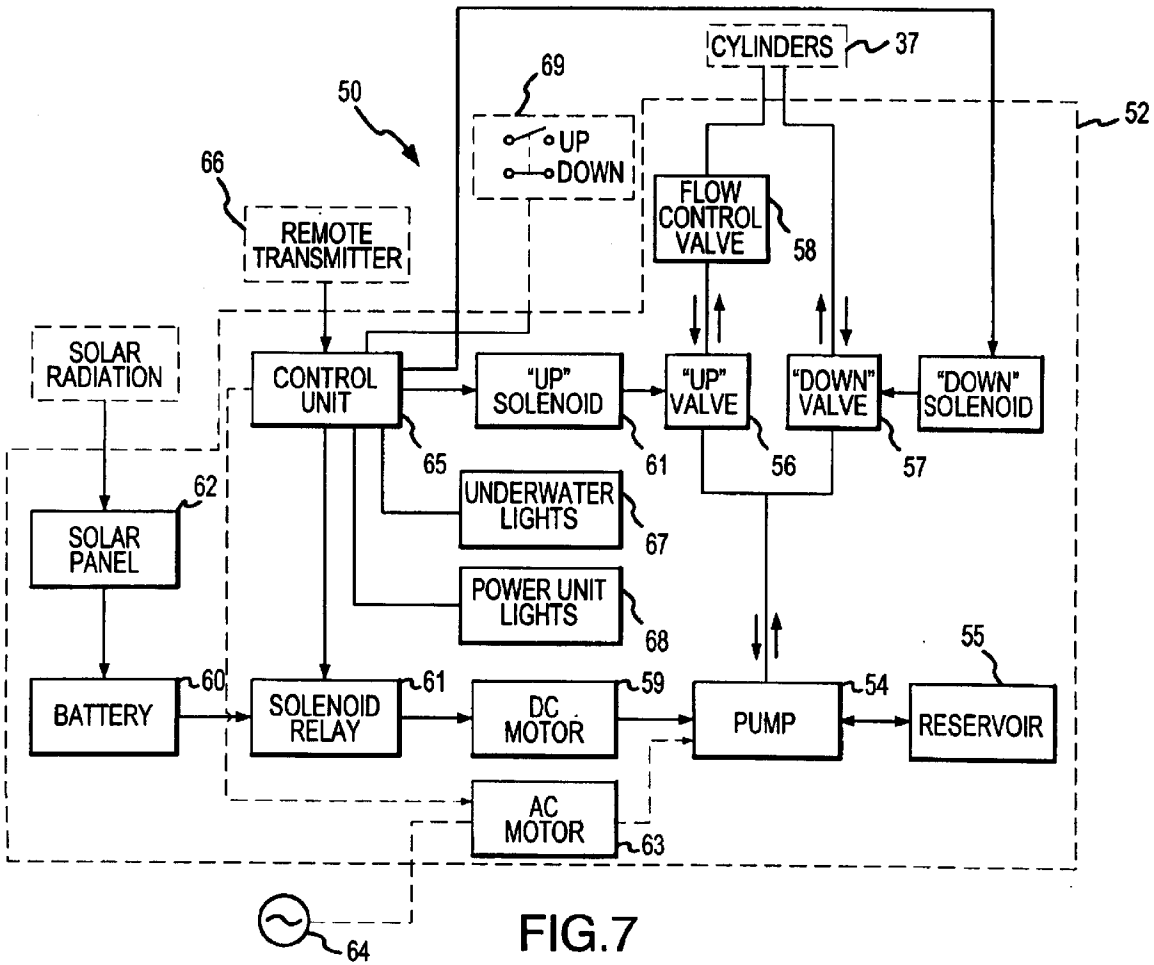
FIG. 7 is a block diagram of a power supply system for a watercraft lift according to another embodiment of the invention.

FIG. 7 is a block diagram of a power supply system 50 according to another embodiment of the invention. The system 50 includes a power module 52 that may be remotely positioned on a dock that is adjacent to the watercraft lift 10. An embodiment of a power module 52 that may be remotely positioned will be described in greater detail below. Although the system 50 depicted in FIG. 7 shows the module 52 operatively coupled to hydraulic cylinders 37, it is understood that other linear actuation devices may be employed, as discussed more fully above. The module 52 generally includes a hydraulic pump 54 that exchanges a hydraulic fluid with a reservoir 55, and is capable of delivering the fluid under pressure to the cylinders 37 through a solenoid-actuated up valve 56 when the cylinders 37 are being extended. A solenoid-actuated down valve 57 may be actuated to release pressurized fluid from the cylinders 37 when the cylinders 37 are being retracted. A flow control valve 58 may be included to control the rate at which the cylinders 37 are extended or retracted. The pump 54 is further coupled to a direct current (DC) motor 59 that receives current from a DC power source, such as a battery 60. The battery 60 may be electrically coupled to the DC motor through a solenoid relay 61, or other power relay devices. The battery 60 may further be electrically coupled to a solar panel 62 that is capable of electrically replenishing the battery 60 when the panel 62 is exposed to solar radiation. Alternatively, the pump 54 may be coupled to an alternating current (AC) motor 63 that is electrically coupled to an AC power source 64.

Still referring to FIG. 7, the module 52 further includes a control unit 65 that is operatively coupled to the up valve 56, the down valve 57, and the solenoid relay 61 to control the operation of these elements. The control unit is further coupled to a limit switch assembly 69 to provide a feedback signal to the control unit 65 that provides an indication signal to the control unit 65 that the watercraft lift is in the fully lowered position, or alternatively, in the fully raised position. The control unit 65 further includes a receiver portion (not shown) that is capable of receiving wireless signals from a remote transmitter 66. The control unit 65 may optionally be coupled to other devices, such as underwater lights 67 that may assist the watercraft operator in positioning the watercraft in the lift 10 during periods of darkness or low visibility, or to power unit lights 68 that may be used to illuminate a portion of the dock supporting the module 52.

With reference still to FIG. 7, the operation of the power system 50 will now be briefly described. When the watercraft operator approaches the watercraft lift, the operator actuates the remote transmitter 66 to emit a wireless signal that is received by the receiver portion of the control unit 65 to command the watercraft lift to move to the lowered position, and otherwise prepare the watercraft lift 10 to receive the watercraft, which may include, for example, energizing any of the lighting systems previously described, in addition to commanding the valves 56 and 57 to move to appropriate positions for lowering the watercraft. The control unit 65 may then command the DC motor 59 to operate by commanding the solenoid relay 61 to move to a closed position. Alternatively, the control unit 65 may cause the AC motor 63 to operate by electrically coupling the AC motor 63 to the AC source 64. In either case, the pump 54 is able to generate sufficient fluid pressure to move the cylinders 51 to the extended position. When the watercraft lift is in the fully lowered position, the limit switch assembly 69 transfers a signal to the unit 65 that indicates that the watercraft lift is in the lowered position, and the unit 65 interrupts the current to the DC motor 59 (or alternatively, the AC motor 63). After the watercraft is suitably positioned on the watercraft lift, the operator again actuates the remote transmitter 66 to emit a signal that is received by the receiver portion of the control unit 65 to command the watercraft lift to move to the raised position. The valves 56 and 57 are moved to positions appropriate for lifting the watercraft, and the DC motor 59 (or alternatively, the AC motor 63) is again energized. When the watercraft lift is in the fully raised position, the limit switch assembly 69 again transfers a signal to the control unit 65, which in turn, again interrupts the current to the DC motor 63.

Figure 8:
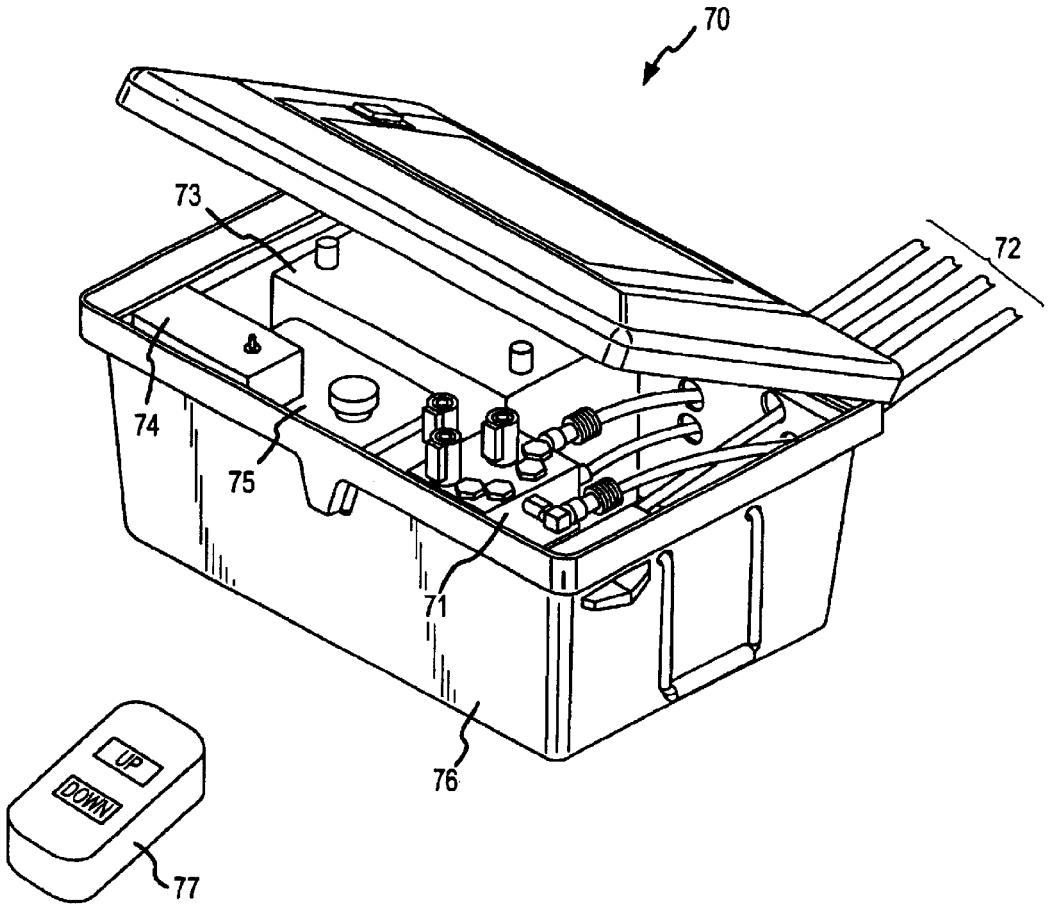
FIG. 8 is an isometric view of a power module according to still another embodiment of the invention.

FIG. 8 is an isometric view of a power module 70 according to another embodiment of the invention. The power module 70 includes a hydraulic power unit 74 having an integral DC motor that is capable of exchanging hydraulic fluid with the cylinders 37 (as shown in FIG. 7) through a plurality of hydraulic hoses 72. The unit 74 is electrically coupled to a battery 73 and to a control unit 75. A receiver 74 is operatively coupled to the control unit 75 in order to receive wireless signals transmitted by a hand held unit 77. The module 70 may be enclosed (with the exception of the unit 77) in a substantially weather proof cabinet 76.

The above description of illustrated embodiments of the invention is not intended to be exhaustive or to limit the invention to the precise form disclosed. While specific embodiments of, and examples of, the inventions are described in the foregoing for illustrative purposes, various equivalent modifications are possible within the scope of the invention as those skilled within the relevant art will recognize. Moreover, the various embodiments described above can be combined to provide further embodiments. Accordingly, the invention is not limited by the disclosure, but instead the scope of the invention is to be determined entirely by the following claims.

What is claimed is:

1. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned vertically below the lifting structure and the lifting structure thereby sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof; and at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof.

2. The watercraft lift of claim 1, wherein the first and second floats each have a non-symmetrical cross-sectional shape with a first cross-sectional axis longer than a transverse second cross-sectional axis such that as the first and second lifting arms move between the first and second positions thereof the first and second floats rotate between an orientation with the first cross-sectional axis extending upward when the first and second lifting arms are in the first position, and an orientation with the first cross-sectional axis extending laterally outward when the first and second lifting arms are in the second position.

3. The watercraft lift of claim 1 further including first and second float guide arms extending laterally outward from the lifting structure, the first and second float guide arms each having a first end portion rigidly connected to the lifting structure and an opposite second end portion, the second end portions of the first and second float guide arms being positioned on opposite sides of the lifting structure to engage the first and second floats, respectively, as the first and second lifting arms are moved from the first position toward the second position to rotatably guide the first and second floats into a predetermined rotational orientation when in position below the lifting structure.

4. The watercraft lift of claim 3 wherein the first and second floats each have a non-symmetrical cross-sectional shape with a first cross-sectional axis longer than a transverse second cross-sectional axis such that as the first and second lifting arms are moved from the second position toward the first position the first and second floats rotate into an orientation with the first cross-sectional axis extending upward when the first and second lifting arms are in the first position, and as the first and second lifting arms are moved from the first position toward the second position the second end portions of the first and second guide arms rotatably guide the first and second floats into the predetermined orientation, the predetermined orientation having the first cross-sectional axis of each of the first and second floats extending laterally outward.

5. The watercraft lift of claim 3 further including rollers rotatably mounted on the second end portions of the first and second float guide arms and positioned to rollably engage an upper surface portion of the first and second floats as the first and second lifting arms are moved from the first position toward the second position to rotatably guide the first and second floats into the predetermined orientation when in position below the lifting structure.

6. The watercraft lift of claim 3 wherein the first and second floats each have an engagement portion engaged by the second end portion of the first and second guide arms, respectively, the engagement portion being oriented such that the buoyancy forces on the first and second floats cause the second end portions of the first and second guide arms to apply forces on the first and second floats, respectively, tending to move the first and second lifting arms toward the second position to lockably retain the first and second lifting arms in the second position.

7. The watercraft lift of claim 1 wherein the first and second drive members comprise first and second actuators.

8. The watercraft lift of claim 7 wherein the first and second actuators comprise first and second hydraulic cylinders.

9. The watercraft lift of claim 7 wherein the first and second actuators comprise first and second jackscrews.

10. The watercraft lift of claim 7 wherein the first and second actuators comprise first and second pneumatic cylinders.

11. The watercraft lift of claim 1, further comprising a power supply system having a source of power and a remotely operable power module capable of receiving wireless signals to actuate the power module, the source of power being operatively connected to the first and second drive members to move the first and second lifting arms between the first and second positions thereof upon actuation of the power module.

12. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof; and first and second float lock arms extending laterally outward from the lifting structure, the first and second float lock arms each having a first end portion rigidly connected to the lifting structure and an opposite second end portion, the second end portions of the first and second float lock arms being positioned on opposite sides of the lifting structure to engage the first and second floats, respectively, when the first and second lifting arms are moved to the second position, the first and second floats each having an engagement portion engaged by the second end portion of the first and second float lock arms, respectively, the engagement portion being arranged such that the buoyancy forces on the first and second floats cause the second end portions of the first and second float lock arms to apply forces on the first and second floats, respectively, tending to move the first and second lifting arms toward the second position to lockably retain the first and second lifting arms in the second position.

13. The watercraft lift of claim 12 further including rollers rotatably mounted on the second end portions of the first and second float lock arms and positioned to rollably engage an upper surface portion of the first and second floats as the first and second lifting arms are moved from the first position toward the second position.

14. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure at a pivotal connection and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned vertically below the lifting structure and the lifting structure thereby sufficiently raised to lift the watercraft out of the water, the pivotal connection of the first end portions of the first and second lifting arms to the lifting structure being at locations spaced apart from the first and second floats to provide a separation between the pivotal connection and the first and second floats as the first and second lifting arms move between the first and second positions, the first end portions of the first and second lifting arms being disconnected from the first and second floats; and at least first and second drive members connected to the lifting structure, the first drive member being connected to the first lifting arm to move the first lifting arm between the first and second positions thereof, and the second drive member being connected to the second lifting arm to move the second lifting arm between the first and second position thereof.

15. The watercraft lift of claim 14 further including first and second float lock arms extending laterally outward from the lifting structure, the first and second float lock arms each having a first end portion rigidly connected to the lifting structure and an opposite second end portion, the second end portions of the first and second float lock arms being positioned on opposite sides of the lifting structure to engage the first and second floats, respectively, when the first and second lifting arms are moved to the second position, the first and second floats each having an engagement portion engaged by the second end portion of the first and second float lock arms, respectively, the engagement portion being arranged such that the buoyancy forces on the first and second floats cause the second end portions of the first and second float lock arms to apply forces on the first and second floats, respectively, tending to move the first and second lifting arms toward the second position to lockably retain the first and second lifting arms in the second position.

16. The watercraft lift of claim 14 wherein the second end portion of the first and second lifting arms are pivotally connected to the first and second floats, respectively.

17. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof; and a power supply system having a source of power and a remotely operable power module capable of receiving wireless signals to actuate the power module, the source of power being operatively connected to the first and second drive members to move the first and second lifting arms between the first and second positions thereof upon actuation of the power module.

18. The watercraft lift of claim 17 wherein the power supply system includes solar panel to produce electrical energy, a battery to store the electrical energy produced by the solar panel, the battery being operatively coupled to the first and second drive members to power the first and second drive members to move the first and second lifting arms.

19. The watercraft lift of claim 18 wherein the first and second drive members are hydraulic actuators, and the power supply system further includes a reservoir of hydraulic fluid, a hydraulic pump connected to the reservoir and to the first and second hydraulic actuators, and a motor, operatively connected to the hydraulic pump, the motor being connected to the battery and powered by the electrical energy stored in the battery to operate the motor and cause the hydraulic pump to provide hydraulic fluid from the reservoir to the first and second hydraulic actuators to move the first and second lifting arms, whereby a self contained power supply is provided for operation of the first and second hydraulic actuators.

20. A watercraft lift for raising and lowering a watercraft, comprising of:

a lifting structure configured to receive and support the watercraft;

first and second floats positioned on opposite sides of the lifting structure and each having a non-symmetrical cross-sectional shape with a first cross-sectional axis longer than a transverse second cross-sectional axis;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof, such that as the first and second lifting arms move between the first and second positions thereof the first and second floats rotate between an orientation with the first cross-sectional axis extending upward when the first and second lifting arms are in the first position, and an orientation with the first cross-sectional axis extending laterally outward when the first and second lifting arms are in the second position; and at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof.

21. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof; and first and second float guide arms extending laterally outward from the lifting structure, the first and second float guide arms each having a first end portion rigidly connected to the lifting structure and an opposite second end portion, the second end portions of the first and second float guide arms being positioned on opposite sides of the lifting structure to engage the first and second floats, respectively, as the first and second lifting arms are moved from the first position toward the second position to rotatably guide the first and second floats into a predetermined rotational orientation when in position below the lifting structure.

22. The watercraft lift of claim 21 wherein the first and second floats each have a non-symmetrical cross-sectional shape with a first cross-sectional axis longer than a transverse second cross-sectional axis such that as the first and second lifting arms are moved from the second position toward the first position the first and second floats rotate into an orientation with the first cross-sectional axis extending upward when the first and second lifting arms are in the first position, and as the first and second lifting arms are moved from the first position toward the second position the second end portions of the first and second guide arms rotatably guide the first and second floats into the predetermined orientation, the predetermined orientation having the first cross-sectional axis of each of the first and second floats extending laterally outward.

23. The watercraft lift of claim 21 further including rollers rotatably mounted on the second end portions of the first and second float guide arms and positioned to rollably engage an upper surface portion of the first and second floats as the first and second lifting arms are moved from the first position toward the second position to rotatably guide the first and second floats into the predetermined orientation when in position below the lifting structure.

24. The watercraft lift of claim 21 wherein the first and second floats each have an engagement portion engaged by the second end portion of the first and second guide arms, respectively, the engagement portion being oriented such that the buoyancy forces on the first and second floats cause the second end portions of the first and second guide arms to apply forces on the first and second floats, respectively, tending to move the first and second lifting arms toward the second position to lockably retain the first second lifting arms in the second position.

25. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof; and at least first and second actuators connected to the lifting structure, the first actuator being connected to the first lifting arm to move the first lifting arm between the first and second positions thereof, and the second actuator being connected to the second lifting arm to move the second lifting arm between the first and second positions thereof.

26. The watercraft lift of claim 25, wherein the first and second actuators comprise and second hydraulic cylinders.

27. The watercraft lift of claim 25, wherein the first and second actuators comprise first and second jackscrews.

28. The watercraft lift of claim 25, wherein the first and second actuators comprise first and second pneumatic cylinders.

29. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned vertically below the lifting structure and the lifting structure thereby sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof; and a power supply system having a source of power and a remotely operable power module capable of receiving wireless signals to actuate the power module, the source of power being operatively connected to the first and second drive members to move the first and second lifting arms between the first and second positions thereof upon actuation of the power module.

30. A watercraft lift for raising and lowering a watercraft, comprising of:

a lifting structure configured to receive and support the watercraft;

first and second floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward whereat the first and second floats are positioned laterally outward of the lifting structure and the lifting structure is sufficiently submerged to receive and deploy the watercraft, and a lowered second position extending downward whereat the first and second floats are positioned below the lifting structure and the lifting structure thereby sufficiently raised to lift the watercraft out of the water;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof;

first and second float lock arms extending laterally outward from the lifting structure, the first and second float lock arms each having a first end portion rigidly connected to the lifting structure and an opposite second end portion, the second end portions of the first and second float lock arms being positioned on opposite sides of the lifting structure to engage the first and second floats, respectively, when the first and second lifting arms are moved to the second position, the first and second floats each having an engagement portion engaged by the second end portion of the first and second float lock arms, respectively, the engagement portion being arranged such that the buoyancy forces on the first and second floats cause the second end portions of the first and second float lock arms to apply forces on the first and second floats, respectively, tending to move the first and second lifting arms toward the second position to lockably retain the first and second lifting arms in the second position; and rollers rotatably mounted on the second end portions of the first and second float lock arms and positioned to rollably engage an upper surface portion of the first and second floats as the first and second lifting arms are moved from the first position toward the second position.

31. A watercraft lift for raising and lowering a watercraft, comprising of:

a lifting structure configured to receive and support the watercraft;

first and second laterally movable floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward with the first and second floats at a first lateral position laterally outward of the lifting structure and the lifting structure sufficiently submerged to receive and deploy the watercraft, and a lowered second position extending downward with the first and second floats at a second lateral position laterally inward of the first lateral position and below the lifting structure and the lifting structure sufficiently raised to lift the watercraft out of the water, the second end portions of the first and second lifting arms being pivotally connected to the first and second floats, respectively, at a location on the first and second floats to cause the first and second floats to rotate about the second end portions relative to the first and second lifting arms under the buoyancy forces on the first and second floats as the first and second lifting arms move between the first and second positions thereof; and at least first and second drive members connected to the lifting structure, the first drive member being connected to the first lifting am, to move the first lifting arm between the first and second positions thereof, and the second drive member being connected to the second lifting arm to move the second lifting arm between the first and second positions thereof.

32. The watercraft lift of claim 31 wherein the first and second floats each have a non-symmetrical cross-sectional shape with a first cross-sectional axis longer than a transverse second cross-sectional axis such that as the first and second lifting arms move between the first and second positions thereof the first and second floats rotate between an orientation with the first cross-sectional axis extending upward when the first and second lifting arms are in the first position, and an orientation with the first cross-sectional axis extending laterally outward when the first and second lifting arms are in the second position.

33. The watercraft lift of claim 31 further including first and second float guide arms extending laterally outward from the lifting structure, the first and second float guide arms each having a first end portion rigidly connected to the lifting structure and an opposite second end portion, the second end portions of the first and second float guide arms being positioned on opposite sides of the lifting structure to engage the first and second floats, respectively, as the first and second lifting arms are moved from the first position toward the second position to rotatably guide the first and second floats into a predetermined rotational orientation when in position below the lifting structure.

34. The watercraft lift of claim 33 wherein the first and second floats each have a non-symmetrical cross-sectional shape with a first cross-sectional axis longer than a transverse second cross-sectional axis such that as the first and second lifting arms are moved from the second position toward the first position the first and second floats rotate into an orientation with the first cross-sectional axis extending upward when the first and second lifting arms are in the first position, and as the first and second lifting arms are moved from the first position toward the second position the second end portions of the first and second guide arms rotatably guide the first and second floats into the predetermined orientation, the predetermined orientation having the first cross-sectional axis of each of the first and second floats extending laterally outward.

35. The watercraft lift of claim 33 further including rollers rotatably mounted on the second end portions of the first and second float guide arms and positioned to rollably engage an upper surface portion of the first and second floats as the first and second lifting arms are moved from the first position toward the second position to rotatably guide the first and second floats into the predetermined orientation when in position below the lifting structure.

36. The watercraft lift of claim 33 wherein the first and second floats each have an engagement portion engaged by the second end portion of the first and second guide arms, respectively, the engagement portion being oriented such that the buoyancy forces on the first and second floats cause the second end portions of the first and second guide arms to apply forces on the first and second floats, respectively, tending to move the first and second lifting arms toward the second position to lockably retain the first and second lifting arms in the second position.

37. The watercraft lift of claim 31 wherein the first and second drive member comprise first and second actuators.

38. The watercraft lift of claim 37 wherein the first and second actuators comprise first and second hydraulic cylinders.

39. The watercraft lift of claim 37 wherein the first and second actuators comprise first and second jackscrews.

40. The watercraft lift of claim 37 wherein the first and second actuators comprise first and second pneumatic cylinders.

41. The watercraft lift of claim 31, further comprising a power supply system having a source of power and a remotely operable power module capable of receiving wireless signals to actuate the power module, the source of power being operatively connected to the first and second drive members to move the first and second lifting arms between the first and second positions thereof upon actuation of the power module.

42. A watercraft lift for raising and lowering a watercraft, comprising of:

a lifting structure configured to receive and support the watercraft;

first and second laterally movable floats positioned on opposite sides of the lifting structure;

at least first and second lifting arms each having a first end portion pivotally connected to the lifting structure and an opposite second end portion connected to one of the first and second floats, the first and second lifting arms being rotatable about the first end portion relative to the lifting structure between a raised first position extending laterally outward with the first and second floats at a first lateral position laterally outward of the lifting structure and the lifting structure sufficiently submerged to receive and deploy the watercraft, and a lowered second position extending downward with the first and second floats at a second lateral position laterally inward of the first lateral position and below the lifting structure and the lifting structure sufficiently raised to lift the watercraft out of the water;

at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof; and first and second float lock arms extending laterally outward from the lifting structure, the first and second float lock arms each having a first end portion rigidly connected to the lifting structure and an opposite second end portion, the second end portions of the first and second float lock arms being positioned on opposite sides of the lifting structure to engage the first and second floats, respectively, when the first and second lifting arms are moved to the second position, the first and second floats each having an engagement portion engaged by the second end portion of the first and second float lock arms, respectively, the engagement portion being arranged such that the buoyancy forces on the first and second floats cause the second end portions of the first and second float lock arms to apply forces on the first and second floats, respectively, tending to move the first and second lifting arms toward the second position to lockably retain the first and second lifting arms in the second position.

43. The watercraft lift of claim 42 further including rollers rotatably mounted on the second end portions of the first and second float lock arms and positioned to rollably engage an upper surface portion of the first and second floats as the first and second lifting arms are moved from the first position toward the second position.

44. A watercraft lift for raising and lowering a watercraft, comprising of:

a lifting structure configured to receive and support the watercraft;

first and second laterally movable floats positioned on opposite sides of the lifting structure;

at least first and second lifting arms each having a first end portion pivotally connected to the lifting structure at a pivotal connection and an opposite second end portion connected to one of the first and second floats, the first and second lifting arms being rotatable about the first end portion relative to the lifting structure between a raised first position extending laterally outward with the first and second floats at a first lateral position laterally outward of the lifting structure and the lifting structure sufficiently submerged to receive and deploy the watercraft, and a lowered second position extending downward with the first and second floats at a second lateral position laterally inward of the first lateral position and below the lifting structure and the lifting structure sufficiently raised to lift the watercraft out of the water, the pivotal connection of the first end portions of the first and second lifting arms to the lifting structure being at locations spaced apart from the first and second floats to provide a separation between the pivotal connection and the first and second floats as the first and second lifting arms move between the first and second positions, the first end portions of the first and second lifting arms being disconnected from the first and second floats; and at least first and second drive members connected to the lifting structure, the first drive member being connected to the first lifting arm to move the first lifting arm between the first and second positions thereof, and the second drive member being connected to the second lifting arm to move the second lifting arm between the first and second positions thereof.

45. The watercraft lift of claim 44 further including first and second float lock arms extending laterally outward from the lifting structure, the first and second float lock arms each having a first end portion rigidly connected to the lifting structure and an opposite second end portion, the second end portions of the first and second float lock arms being positioned on opposite sides of the lifting structure to engage the first and second floats, respectively, when the first and second lifting arms are moved to the second position, the first and second floats each having an engagement portion engaged by the second end portion of the first and second guide arms, respectively, the engagement portion being arranged such that the buoyancy forces on the first and second floats cause the second end portions of the first and second guide arms to apply forces on the first and second floats, respectively, tending to move the first and second lifting arms toward the second position to lockably retain the first and second lifting arms in the second position.

46. The watercraft lift of claim 44 wherein the second end portion of the first and second lifting arms are pivotally connected to the firstand second floats, respectively.

* * * * *